US007171366B2

(12) United States Patent
Furuta

(10) Patent No.: US 7,171,366 B2
(45) Date of Patent: Jan. 30, 2007

(54) METHOD AND APPARATUS FOR VOICE-ACTIVATED CONTROL OF ATTACHMENT OF CONSTRUCTION MACHINE

(75) Inventor: Hideto Furuta, Tokyo (JP)

(73) Assignee: Shin Caterpillar Mitsubishi Ltd., Tokyo (JP)

( * ) Notice: Subject to any disclaimer, the term of this patent is extended or adjusted under 35 U.S.C. 154(b) by 714 days.

(21) Appl. No.: 10/070,945

(22) PCT Filed: Mar. 9, 2001

(86) PCT No.: PCT/JP01/01856

§ 371 (c)(1),
(2), (4) Date: Mar. 13, 2002

(87) PCT Pub. No.: WO02/06591

PCT Pub. Date: Jan. 24, 2002

(65) Prior Publication Data

US 2002/0150267 A1 Oct. 17, 2002

(30) Foreign Application Priority Data

Jul. 18, 2000 (JP) ..... 2000-217547

(51) Int. Cl.
*G10L 21/00* (2006.01)

(52) U.S. Cl. ..... 704/275

(58) Field of Classification Search ..... 704/270, 704/275

See application file for complete search history.

(56) References Cited

U.S. PATENT DOCUMENTS 5,535,532 A * 7/1996 Fujii et al. ..... 37/348
6,131,061 A * 10/2000 DenBraber et al. ..... 701/50

FOREIGN PATENT DOCUMENTS

| | | |
|---|---|---|
| JP | 62-7417 | 1/1987 |
| JP | 5-94463 | 12/1993 |
| JP | 5-332033 | 12/1993 |
| JP | 6-33615 | 2/1994 |
| JP | 6-109877 | 4/1994 |
| JP | 6-43062 | 6/1994 |
| JP | 8-302749 | 11/1996 |
| JP | 9-265298 | 10/1997 |
| JP | 11-293709 | 10/1999 |
| JP | 2000-56827 | 2/2000 |

OTHER PUBLICATIONS

Japanese Office Action issued Sep. 7, 2004, with English translation.

* cited by examiner

*Primary Examiner*—Abul K. Azad
(74) *Attorney, Agent, or Firm*—Morrison & Foerster LLP

(57) ABSTRACT

A voice attachment control apparatus (1) for a construction machine (80) is provided. The voice attachment control apparatus (1) includes speech analysis means (1*a*) for speech-analyzing a voice command representative of an instruction by voice regarding a movement of an attachment (401), speech discrimination means (1*b*) connected to the speech analysis means (1*a*) for discriminating the instruction of the voice command, machine body control means (1*c*) connected to the speech discrimination means (1*b*) and operable of controlling movement of the attachment (401) based on the instruction, and speech synthesis means (1*d*) for conveying a working situation of the attachment (401) to an operator of the machine body (80). The voice attachment control apparatus (1) uses voice to control starting, stopping and speed adjustment of the attachment (401) to improve the safety of the working person.

6 Claims, 9 Drawing Sheets

METHOD AND APPARATUS FOR VOICE-ACTIVATED CONTROL OF ATTACHMENT OF CONSTRUCTION MACHINE

TECHNICAL FIELD

This invention relates to a voice attachment control apparatus and a voice attachment control method for a construction machine suitable for use, for example, with a hydraulic excavator for excavating the ground or a like machine.

BACKGROUND ART

Generally, a construction machine such as a hydraulic excavator has a construction wherein it includes an upper revolving unit with an operator cab (cabin) provided on a lower traveling body having caterpillar members, and further, a joint type arm mechanism composed of a boom, a stick and a bucket is provided on the upper revolving unit.

Not only the bucket but also various attachment elements (which may hereinafter referred to merely as attachments) are attached to an end portion of the stick in accordance with a working application of the construction machine.

FIGS. 6(*a*) and 6(*b*) are schematic views of different attachments, respectively. The attachment shown in FIG. 6(*a*) is a bucket used principally for excavation, and the attachment shown in FIG. 6(*b*) is a shear. The shear can perform a movement of grasping an object and a rotational operation, and, for example, can grasp and rotate a steel frame or the like and shear the steel frame. Also a hammer (not shown) or the like can be attached, and the attachment to be attached to the stick can be replaced selectively from among various attachments in accordance with a working application.

FIG. 7 is a schematic diagram of functional blocks of an electronic control apparatus. The electronic control apparatus (controller) 50 shown in FIG. 7 is a control apparatus for operating movements of a hydraulic excavator and an attachment and includes a machine body control means 50*a*. The machine body control means 50*a* is connected to attachment switches 6*a*, 6*b*, an operation lever (joystick) 6, pedals 9*a*, 9*b*, an ON/OFF valve 13, a solenoid proportional valve 3 and so forth.

The attachment switches 6*a*, 6*b* are switches for starting/stopping the attachment, respectively, and the operation lever 6 is provided to operate the machine body. In addition, the pedals 9*a*, 9*b* are provided to move the machine body forwardly/backwardly to the left side and called modulation pedals or attachment input modulation pedals. The position of the operation lever 6 and the positions of the pedals 9*a*, 9*b* adjusted by the operator (which may be hereinafter referred to as operating person) are read in by the electronic control apparatus 50.

The ON/OFF valve 13 is a main control valve and controls movement of actuators (hydraulic cylinders). The solenoid proportional valve 3 uses hydraulic pressure to control the spool position of the ON/OFF valve 13.

Thus, control of the attachment (hammer, shear or the like) of the conventional hydraulic excavator is performed through the ON/OFF switch provided at an upper portion of the operation lever 6 or the pedals 9*a*, 9*b*.

FIG. 8 is a schematic view of the operation lever 6, and the operation lever 6 is tilted in the forward, backward, leftward or rightward direction by operation of the operator. If the operator tilts the operation lever 6, then the tilted position of the operation lever 6 is read in by the machine body control means 50*a* (refer to FIG. 7) and the solenoid proportional valve 3 is adjusted.

The attachment switch (for starting) 6*a* and the attachment switch (for stopping) 6*b* are provided at an upper portion of the operation lever 6 shown in FIG. 8. If the operator depresses the attachment switch 6*a*, then the machine body control means 50*a* adjusts the ON/OFF valve 13 to start movement of the attachment. Similarly, if the operator depresses the attachment switch 6*b*, then the movement of the attachment is stopped.

FIG. 9 is a schematic view of the pedal 9*a* (or pedal 9*b*). If the operator operates the pedal 9*a*, then the direction of movement of the pedal 9*a* is adjusted, and consequently, operation of the attachment is performed.

The prior art, however, has a subject to be solved in that it imposes a very heavy burden on the operator for the operator to operate the attachment while such operations as operations of the boom, stick, bucket and upper revolving unit for pivoting and revolving movements are performed.

The present invention has been made in view of such a subject as described above, and it is an object of the present invention to provide a voice attachment control apparatus and a voice attachment control method for a construction machine such as a hydraulic excavator which uses, in order to control an interlocking movement by a plurality of actuators, voice to control an attachment in starting, stopping and speed adjustment to improve the safety of the working person.

DISCLOSURE OF INVENTION

In order to attain the object described above, according to an aspect of the present invention, a voice attachment control apparatus for a construction machine which has an attachment element as a construction working member connected to actuators is characterized in that it comprises speech analysis means for speech-analyzing a voice command representative of an instruction by voice regarding a movement of the attachment element, speech discrimination means, connected to the speech analysis means, for discriminating the instruction of the voice command, and machine body control means, connected to the speech discrimination means, and operable of controlling movement of the attachment element based on the instruction.

Accordingly, with the voice attachment control apparatus, the operator can operate the attachment element by voice. Further, the operator can concentrate its attention upon operation of a boom, a stick and a bucket which are principal ones of the actuators and operation for revolving motion.

The machine body control means may set values relating to a movement position and a speed of the attachment element or may include speech synthesis means for conveying a working situation of the attachment element to an operator of the construction machine.

The machine body control means may set values relating to a movement position and a speed of the attachment element, or may include speech synthesis means for conveying a working situation of the attachment element to an operator of the construction machine.

Accordingly, with the voice attachment control apparatus, starting, stopping and speed change of the attachment element can be performed, and also in this instance, the operator can concentrate its attention on operation of another actuator, resulting in the advantage that the safety is improved.

According to another aspect of the present invention, a voice attachment control method for a construction machine is characterized in that it comprises, in order to operate a shear connected to actuators and operable of performing a movement of grasping an object and a rotational movement as an attachment element as a construction working member, a first movement step of speech-analyzing a voice command representative of an instruction by voice regarding a movement of the attachment element to discriminate the instruction of the voice command and performing a first movement of the actuators, a stopping step of stopping the shear once after the first movement step, and a second movement step of speech-analyzing, after the stopping step, another voice command to discriminate a second instruction of the voice command and performing a second movement of the actuators based on the second instruction.

Accordingly, with the voice attachment control method, the operator need not utter a starting command for a rotational operation or a grasping operation any more.

According to a further aspect of the present invention, a voice attachment control method for a construction machine is characterized in that it comprises, in order to operate a shear connected to actuators and operable of performing a movement of grasping an object and a rotational movement as an attachment element as a construction working member, an interlocking movement step of speech-analyzing a voice command representative of an instruction by voice regarding an interlocking movement of the attachment element which includes a plurality of movements to be performed simultaneously to discriminate the instruction of the voice command and performing the interlocking movement of the actuators based on the instruction.

Accordingly, with the voice attachment control method, where a shear is attached as the attachment element, the operator can perform a rotational operation and a grasping operation simultaneously through a voice command representative of an interlocking movement of a plurality of movements, resulting in the advantage that the operability is improved.

BEST MODE FOR CARRYING OUT THE INVENTION (A) Description of the First Embodiment of the Present Invention In the following, an embodiment of the present invention is described with reference to the drawings.

Figure 1:
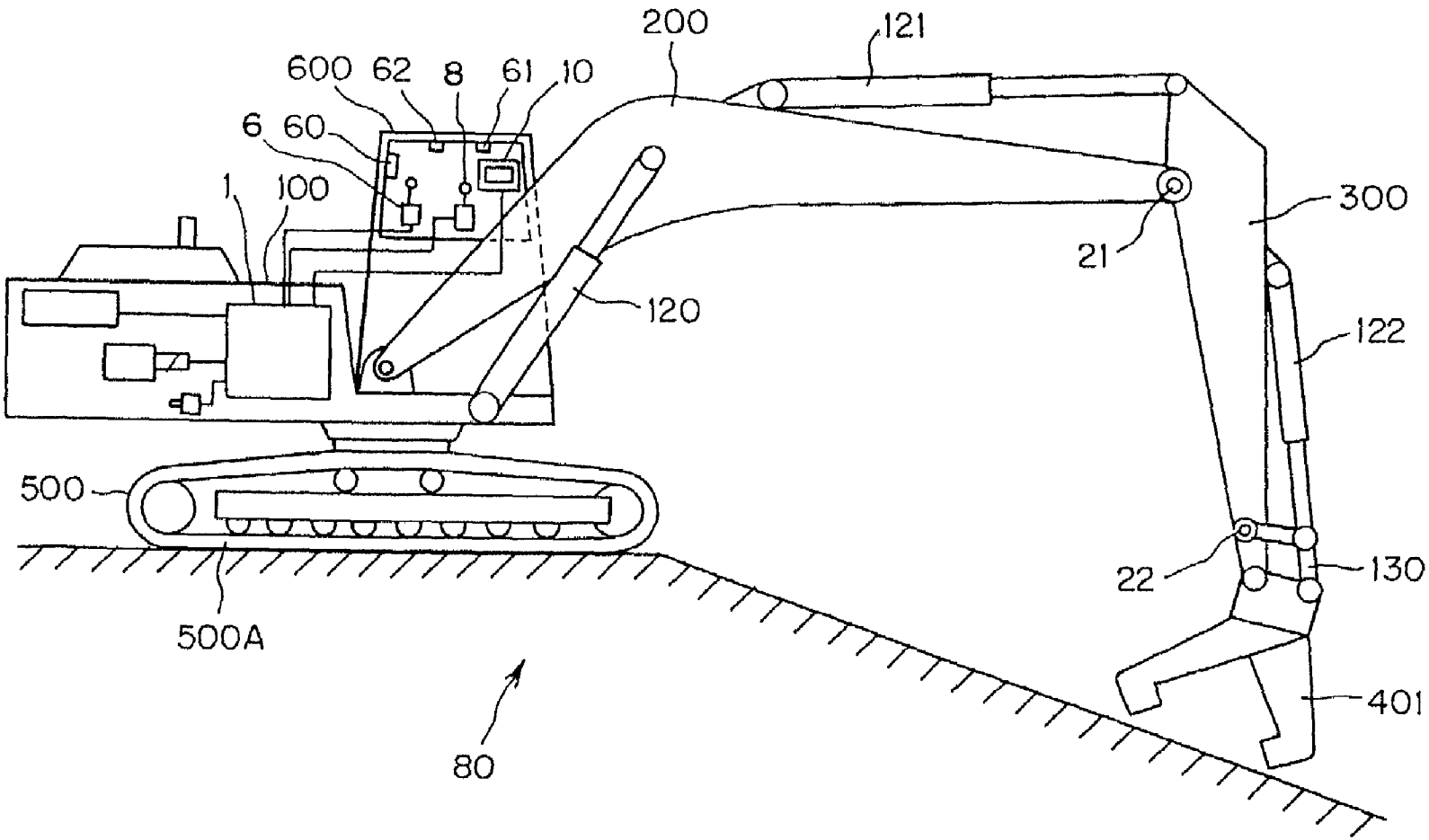
FIG. 1 is a schematic view showing a configuration of a hydraulic excavator according to an embodiment of the present invention.

FIG. 1 is a schematic view showing a configuration of a hydraulic excavator according to an embodiment of the present invention. A hydraulic excavator 80 (which may be hereinafter referred to merely as machine body) shown in FIG. 1 is a construction machine having an attachment as a construction working member connected to actuators. The hydraulic excavator 80 includes a lower traveling body 500 having caterpillar members 500A on the left and right thereof, and a upper revolving unit 100 with an operator cab 600 provided for revolving motion within a horizontal plane on the lower traveling body 500.

A boom 200 having one end connected for swinging motion is provided on the upper revolving unit 100, and a stick 300 connected at one end thereof for swinging motion by a joint part 21 is provided on the boom 200. Further, a shear 401 which is connected at one end thereof for swinging motion by a joint part 22 and can excavate the ground with a tip thereof and accommodate earth and sand therein is provided on the stick 300. The boom 200, stick 300 and shear 401 cooperatively form a joint type arm mechanism.

Further, a boom hydraulic cylinder 120, a stick hydraulic cylinder 121 and a bucket hydraulic cylinder 122 are provided as cylinder type actuators. It is to be noted that, in the following description, the boom hydraulic cylinder 120 is sometimes referred to as cylinder 120, the stick hydraulic cylinder 121 as cylinder 121, and the bucket hydraulic cylinder 122 merely as cylinder 122.

The boom hydraulic cylinder 120 is connected at one end thereof for swinging motion to the upper revolving unit 100 and is connected at the other end thereof for swinging motion to the boom 200. In other words, the boom hydraulic cylinder 120 is interposed between the upper revolving unit 100 and the boom 200, such that, as the distance between the opposite end portions thereof is expanded or contracted, the boom 200 can be swung with respect to the upper revolving unit 100.

The stick hydraulic cylinder 121 is connected at one end thereof for swinging motion to the boom 200 and connected at the other end thereof for swinging motion to the stick 300. In other words, the stick hydraulic cylinder 121 is interposed between the boom 200 and the stick 300, such that, as the distance between the opposite end portions thereof is expanded or contracted, the stick 300 can be swung with respect to the boom 200.

The bucket hydraulic cylinder 122 is connected at one end thereof for swinging motion to the stick 300 and connected at the other end thereof for swinging motion to the shear 401. In other words, the bucket hydraulic cylinder 122 is interposed between the stick 300 and the shear 401, such that, as the distance between the opposite end portions thereof is expanded or contracted, the shear 401 can be swung with respect to the stick 300. It is to be noted that a linkage mechanism 130 is provided at a free end portion of the bucket hydraulic cylinder 122.

In this manner, a cylinder type actuator mechanism having a plurality of cylinder type actuators for driving the arm mechanism by performing expanding or contracting operations is composed of the cylinders 120 to 122 described above.

In the operator cab 600 shown in FIG. 1, the operation levers 6, 8, a monitor 10, an operation panel 60 with a key pad (also referred to as operation panel), a microphone 61, a speaker 62 and so forth are provided. The operation lever 6 is used for position adjustment of the stick 300 and revolving motion of the upper revolving unit 100. The operation lever 8 is used for position adjustment of the boom 200 and the shear 401. Each of the operation levers 6, 8 is tilted to a forward, a backward or a neutral position or to a leftward, a rightward or a neutral position by the operator to perform the position adjustment.

Figure 2:
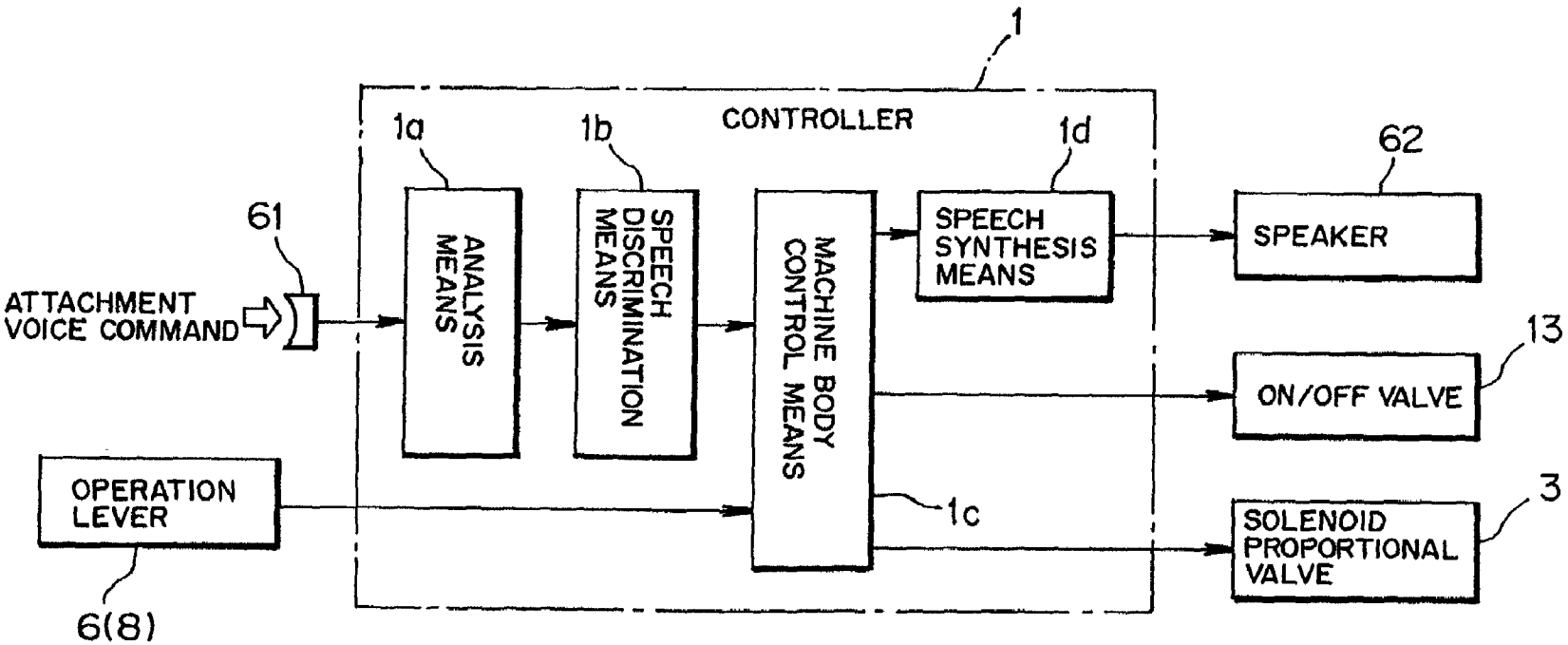
FIG. 2 is a functional block diagram of an electronic control apparatus according to the embodiment of the present invention.

Further, an electronic control apparatus 1 is provided in the inside of the upper revolving unit 100 shown in FIG. 1. FIG. 2 is a functional block diagram of the electronic control apparatus 1 according to the embodiment of the present invention. The electronic control apparatus 1 shown in FIG. 2 is a voice attachment control apparatus for a construction machine and controls the boom 200, stick 300 and shear 401 to effect desired expansion/contraction displacements in accordance with a mode in which the operator wants to control them.

The electronic control apparatus 1 includes a speech analysis means 1*a*, a speech discrimination means 1*b*, a machine body control means 1*c* and a speech synthesis means 1*d*. It is to be noted that the electronic control apparatus 1 is composed of a microprocessor, memories such as a ROM (Read Only Memory) and a RAM (Random Access Memory), suitable input/output interfaces and so forth.

The speech analysis means 1*a* performs speech analysis of a voice command representative of an instruction by voice relating to a movement of the attachment, and this function is implemented, for example, by software or hardware. The speech analysis means 1*a* receives an input of a voice command signal of the operator obtained by the microphone 61 and performs speech processing of the voice command signal. The speech discrimination means 1*b* is connected to the speech analysis means 1*a* and discriminates the instruction of the voice command, and is implemented, for example, by software.

The voice command signifies an instruction such as "boom up", "stick in" or "bucket close" uttered by the operator.

The machine body control means 1*c* is connected to the speech discrimination means 1*b* and can control the movement of the attachment in accordance with the instruction, and this function is implemented, for example, by software. The machine body control means 1*c* is connected to the operation levers 6, 8 and is connected also to the ON/OFF valve 13 and the solenoid proportional valve 3.

The machine body control means 1*c* sets values regarding the movement position and the speed of the attachment element, and the setting upon movement of the attachment is performed by voice. The setting contents include ① maximum and minimum flow rates to be allocated to the attachment, ② maximum and minimum electric currents to the attachment solenoid proportional valve and a maximum engine speed, ③ a maximum acceleration dial and speed changeover level, and ④ a speed modulation.

The speech synthesis means 1*d* conveys a working situation of the attachment to the operator of the machine body and is implemented, for example, by software or hardware.

Consequently, if the operator utters a voice command relating to an operation of the attachment, then the voice command is converted into a voice signal by the microphone 61 and speech-processed by the speech analysis means 1*a*. Then, the speech discrimination means 1*b* extracts an instruction such as "boom up" regarding an operation of the attachment from the speech-processed voice command, and the machine body control means 1*c* controls the movement of the attachment based on the instruction of "boom up".

Further, the positions of the operation levers 6, 8 tilted by the operator are read in by the machine body control means 1*c*, and the ON/OFF valve 13 and the solenoid proportional valve 3 are controlled so that they may individually perform suitable movements. More particularly, the ON/OFF valve 13 and the solenoid proportional valve 3 operate so that the shear 401 performs a cutting movement or a rotational movement.

Regarding a voice attachment control method for a construction machine of the present invention having the configuration described above, setting before starting is described with reference to FIG. 3 and control of the shear 401 is described in detail with reference to FIGS. 4 and 5.

Figure 3:
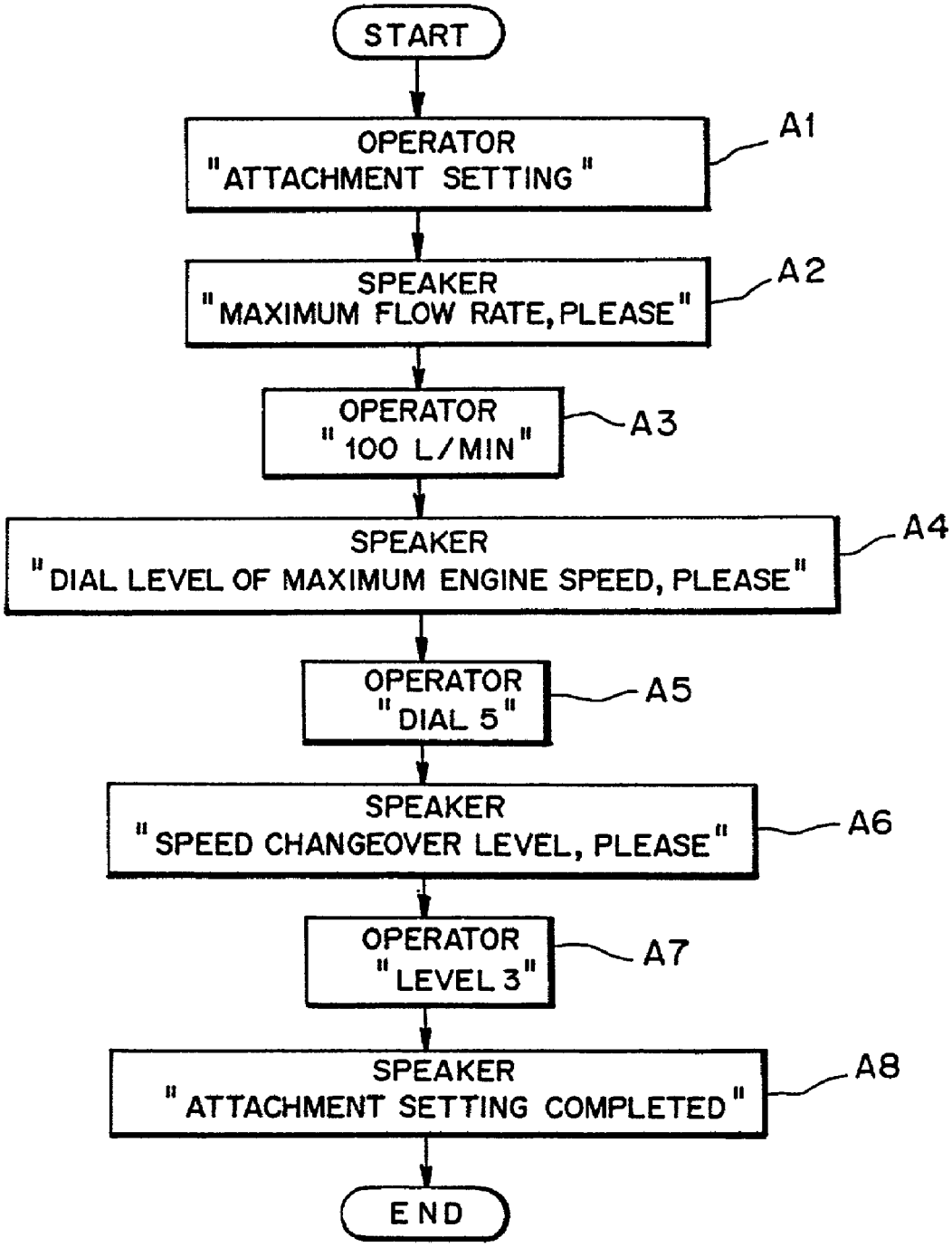
FIG. 3 is a flowchart illustrating voice attachment setting according to the embodiment of the present invention.

FIG. 3 is a flowchart illustrating voice attachment setting according to the embodiment of the present invention. First, the operator will utter "attachment setting" before starting (step A1). Here, the speaker 62 communicates "maximum flow rate, please" (step A2), and the operator will utter, for example, "100 litter per minute" (stepA3). Then, the speaker 62 communicates "dial level of maximum engine speed, please" (step A4), and the operator will utter, for example, "dial 5" (step A5). Further, the speaker 62 communicates "speed changeover level, please" (step A6), and the operator will utter, for example, "level 3" (step A7). Then, the speaker 62 communicates "attachment setting completed" thereby to complete the attachment setting (step A8).

Figure 4:
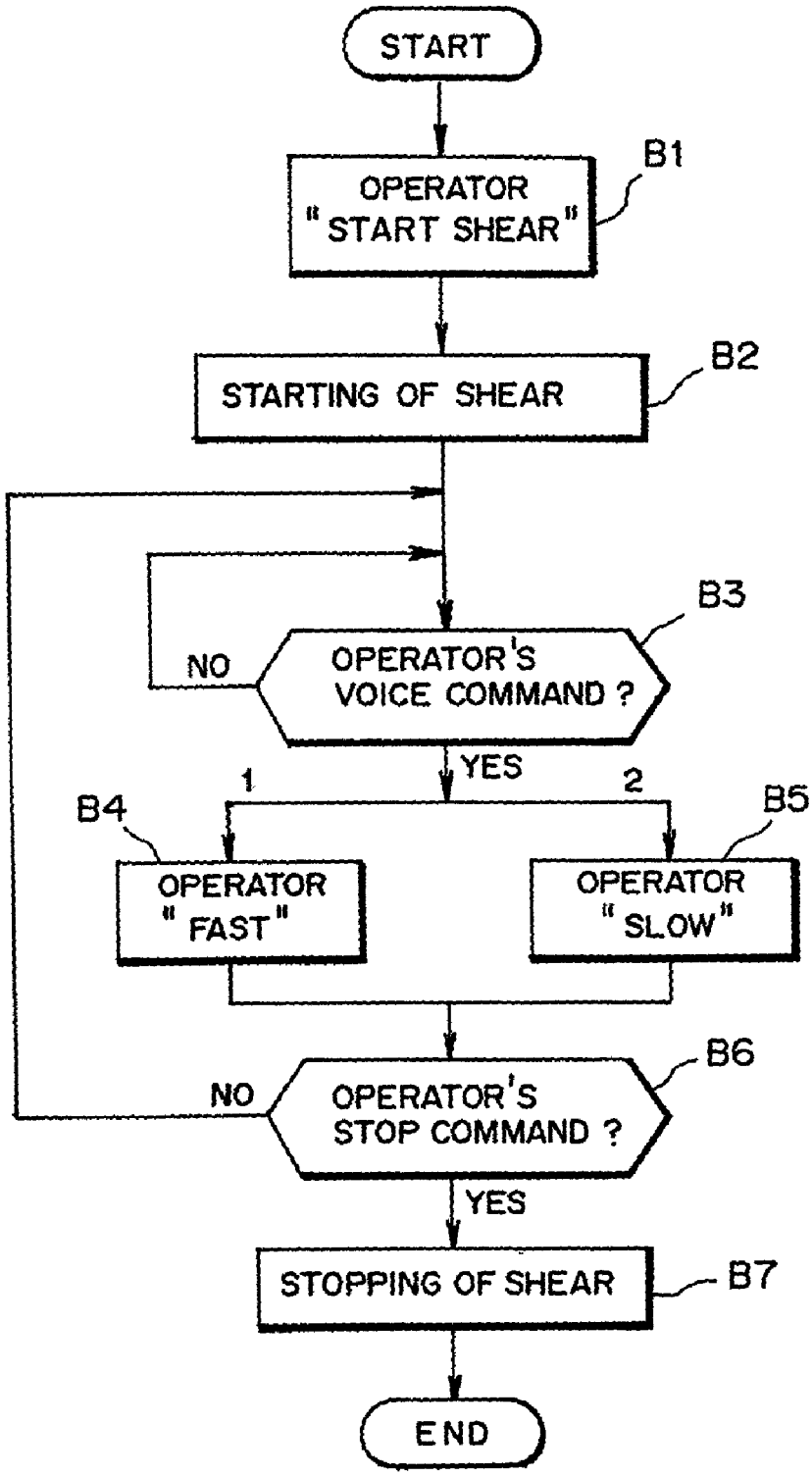
FIG. 4 is a flowchart illustrating speed adjustment of a shear according to the embodiment of the present invention.
Figure 5:
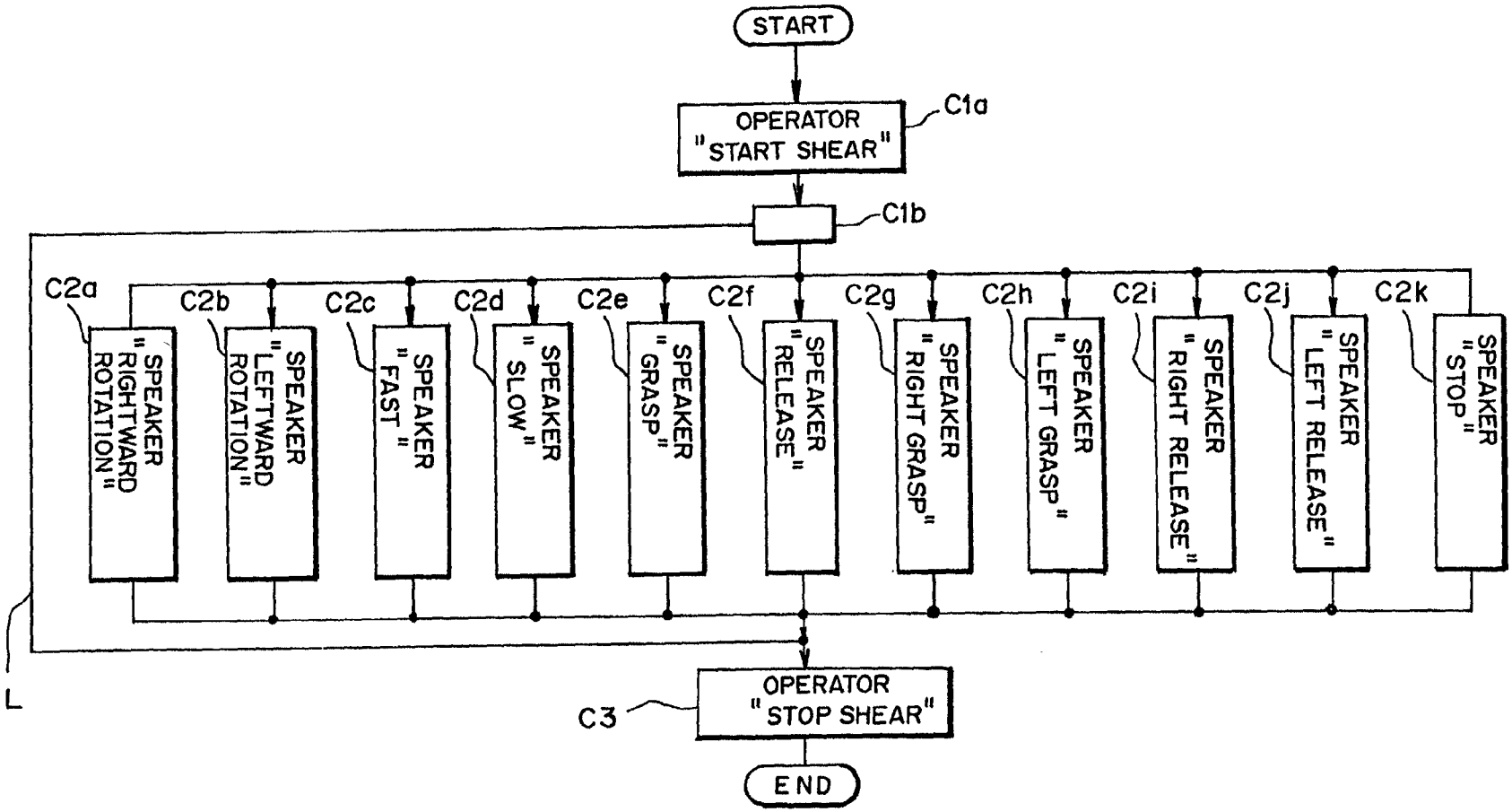
FIG. 5 is a flowchart illustrating continuous operation of the shear according to the embodiment of the present invention.
Figure 6A:
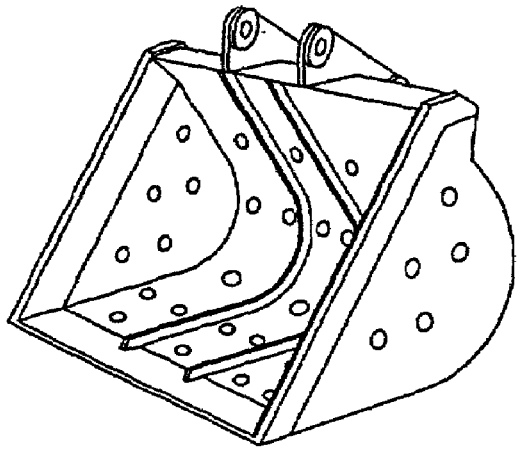
FIGS. 6(*a*) and 6(*b*) are schematic views of different attachments respectively.
Figure 6B:
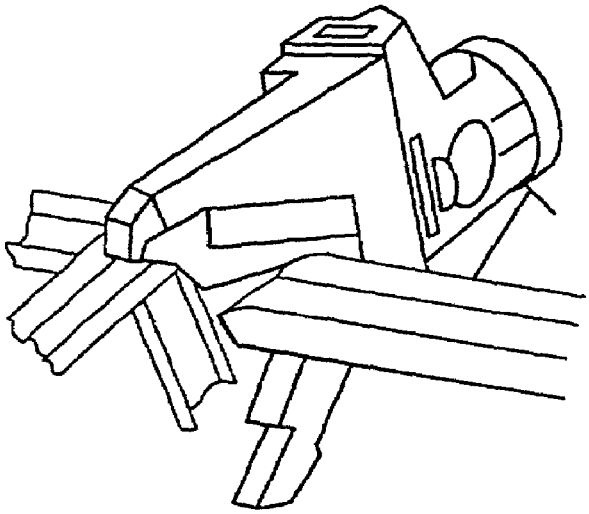
Figure 7:
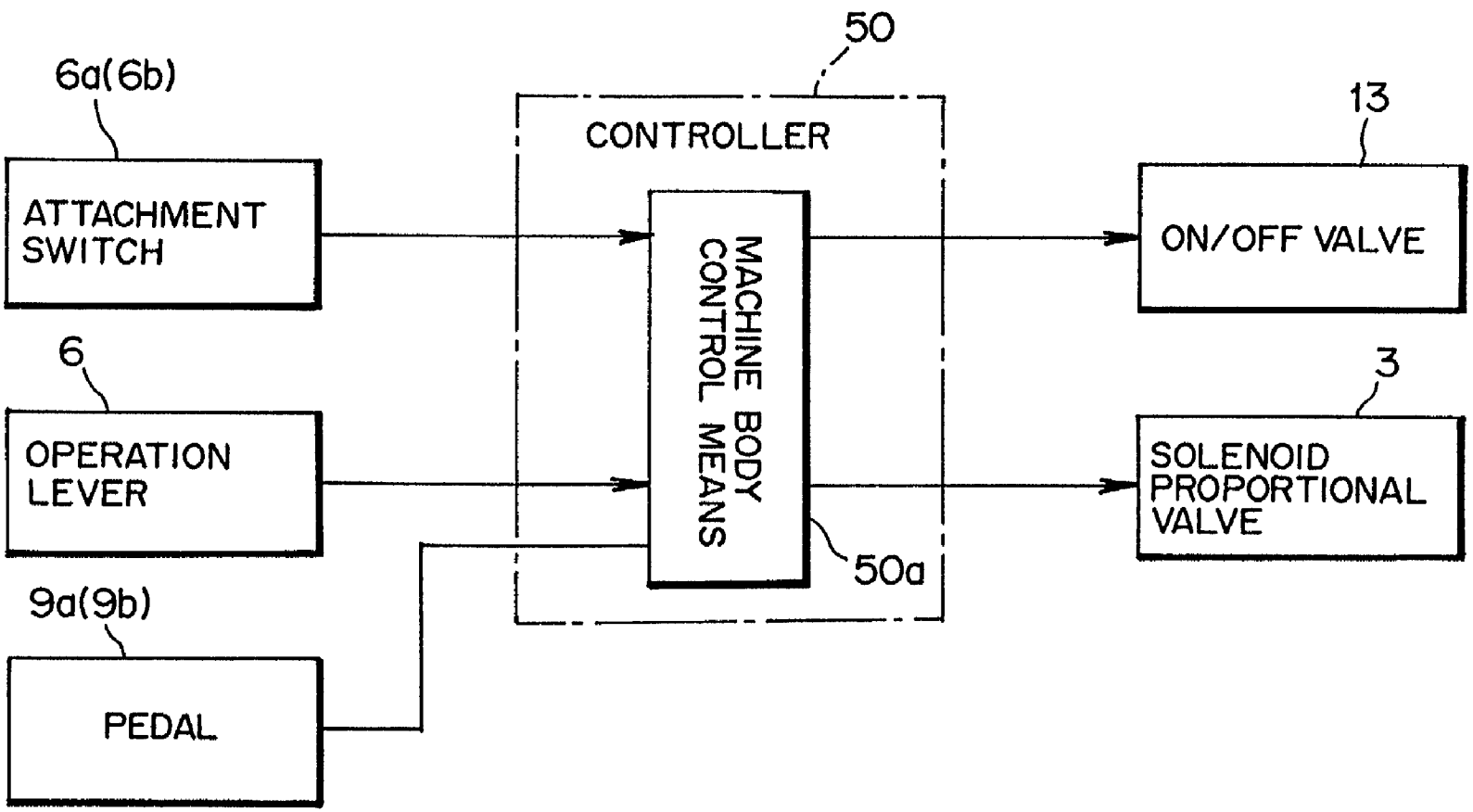
FIG. 7 is a schematic view of functional blocks of an electronic control apparatus.
Figure 8:
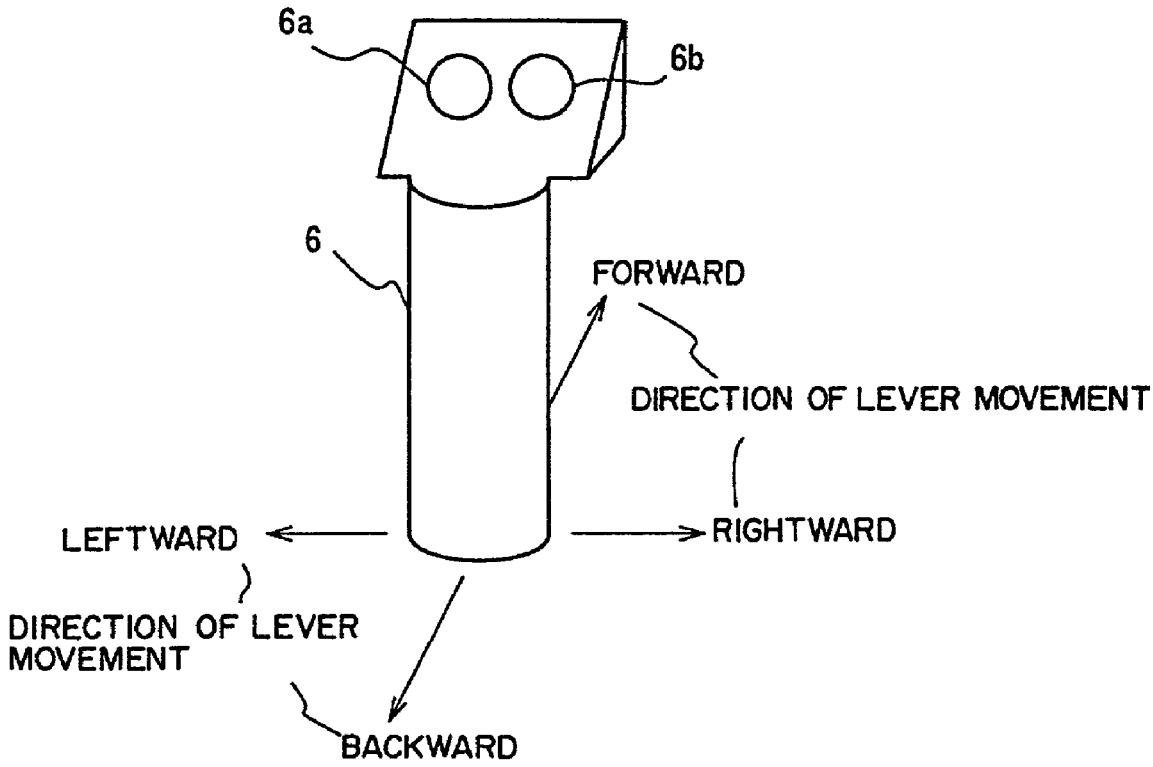
FIG. 8 is a schematic view of an operation lever.
Figure 9:
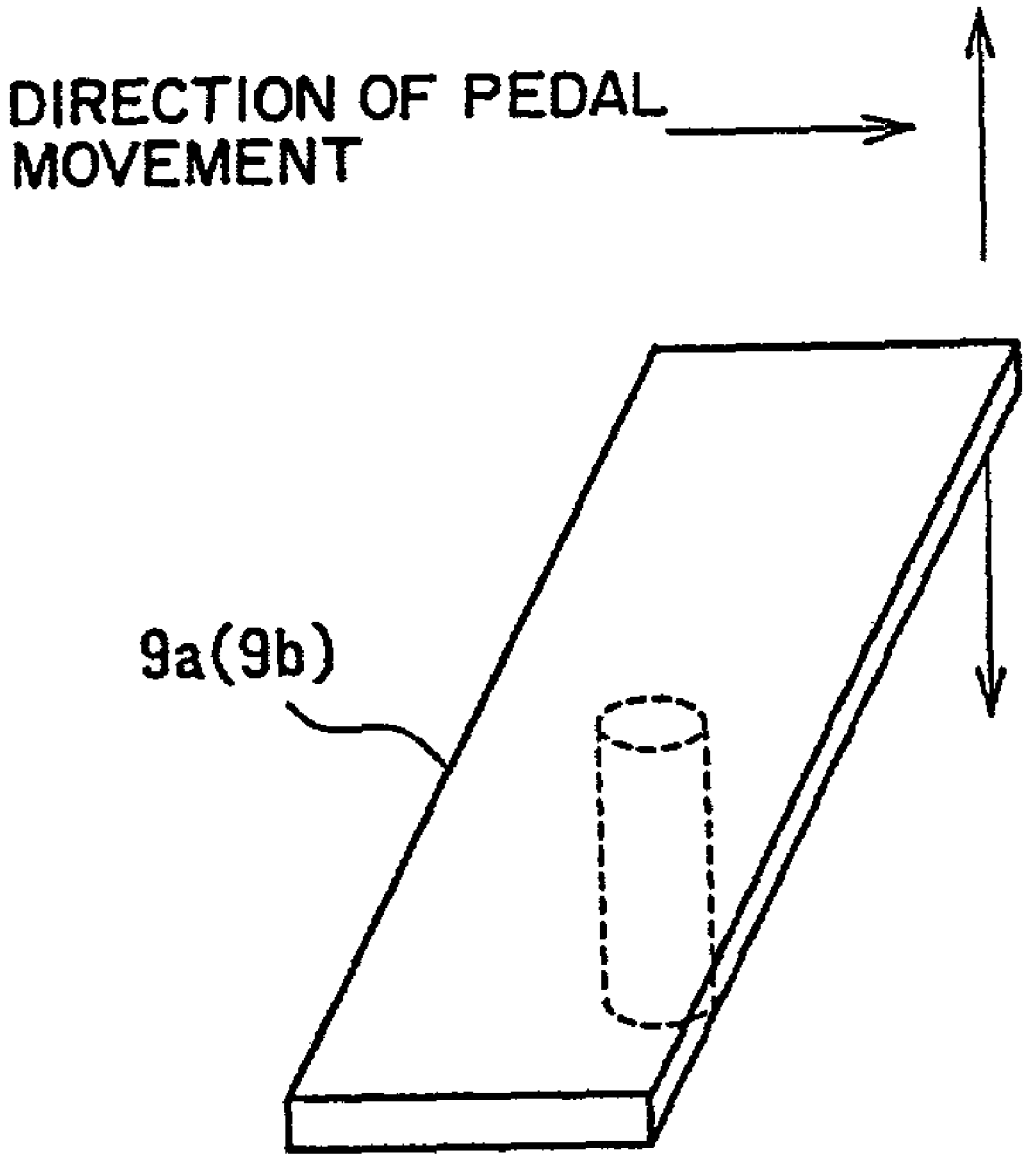
FIG. 9 is a schematic view of a pedal.

FIG. 4 is a flowchart illustrating speed adjustment of the shear 401 according to the embodiment of the present invention. First, if the operator utters "start shear" (step B1), then the shear 401 starts its movement (step B2). Then, while no voice command by the operator is inputted, the processing passes the NO route of step B3, but if a voice command is inputted, then the processing passes the YES route of step B3 and advances to step B4 denoted by 1 or to step B5 denoted by 2. In step B4, if the speech discrimination means 1*b* discriminates that the operator has uttered "fast", then the machine body control means 1*c* raises the speed of rotation of the shear 401. In step B5, if the speech discrimination means 1*b* discriminates that the operator has uttered "slow", then the machine body control means 1*c* lowers the speed of rotation of the shear 401. Then in step B6, it is discriminated whether or not the stop command by the operator is inputted. While the stop command is not inputted, the processing passes the NO route, and the processes beginning with step B3 are repeated. On the other hand, if the operator utters the stop command in step B6, then the processing passes the YES route, and the shear 401 is stopped in step B7.

Now, control of the shear 401 when another operation is performed continuously during movement of the shear 401 is described with reference to FIG. 5. FIG. 5 is a flowchart illustrating continuous operation of the shear 401 according to the embodiment of the present invention.

First, if the operator utters "start sear" (step C1*a*), then the shear 401 starts its rotational movement, and in order to grasp an object, a suitable hydraulic pressure is applied to make preparations for the movement. Further, if the rotation of the shear 401 is rightward/leftward rotation, then the speaker 62 communicates "rightward rotation"/"leftward rotation" in step C2*a*/step C2*b*, respectively. In this state, the processing passes a route denoted by L and returns to step C1*b*.

Here, if the operator utters "fast"/"slow" (step C2*c*/step C2*d*), then the speed of rotation of the shear 401 is increased/decreased, and then the processing returns to step C1*b*.

If the operator utters "grasp"/"release" (step C2*e*/step C2*f*", then the shear 401 grasps or release, for example, a steel frame, whereafter the processing returns to step C1*b*.

If the operator utters "right grasp" (step C2*g*), then the shear 401 moves the right side grasping portion thereof to grasp a steel frame while movement of the left side grasping portion thereof is kept stopped. Similarly, if the operator utters "left grasp" (step C2*h*), then the shear 401 moves the left side grasping portion to grasp a steel frame while movement of the right side grasping portion is kept stopped.

On the contrary, if the operator utters "right release" (step C2*i*), then the shear 401 moves the right side grasping portion thereof to release the steel frame while the steel frame is kept grasped by the left side grasping portion of the two grasping portions. Similarly, if the operator utters "left release" (step C2*j*), then the shear 401 moves the left side grasping portion thereof to release the steel frame while the steel frame is kept grasped by the right side grasping portion.

Then, if the operator utters "stop" (step C2*k*), then the movement of the shear 401 is stopped temporarily. If the operator utters "stop shear" (step C3), then the shear 401 stops its movement completely. Thus, while the shear 401 is moving, the voice command of "stop" signifies temporary stopping of the shear 401 but does not signify complete stopping.

Accordingly, in the voice attachment control method for a construction machine of the present invention, when the shear 401 connected to the actuators and operable of performing a movement of grasping an object and a rotational movement as an attachment element as a construction working member is to be operated, a voice command representative of an instruction by voice regarding a movement of the attachment element is speech-analyzed to discriminate the instruction of the voice command, and a movement (for example, right grasp) of the actuators based on the instruction is performed (first movement step).

After the first movement step, the shear 401 is stopped once (stopping step).

After the stopping step, another voice command is speech-analyzed to discriminate a second instruction of the voice command and a second movement (for example, right release) of the actuators based on the second instruction is performed (second movement step).

In this manner, where the shear 401 is attached as the attachment, when another sole operation is to be started after the operator stops its operation once, a voice command inputting operation for starting every time is not required, and the operator can directly utter a voice command for movement to cause the shear 401 to move.

Also it is possible to combine a plurality of operations in order to eliminate the complexity involved in individual utterances of different movements of the shear 401.

In particular, the voice attachment control method for a construction machine of the present invention includes, in order to operate the shear 401 connected to the actuators and operable of performing a movement of grasping an object and a rotational movement as an attachment element as a construction working member, an interlocking movement step of speech-analyzing a voice command representative of an instruction by voice regarding an interlocking movement which includes a plurality of movements of the attachment to be performed simultaneously to discriminate the instruction of the voice command and performing an interlocking movement of the actuators.

Since the shear 401 is operated in composite operations of an operation for a movement of grasping a steel frame and an operation for a rotational movement in this manner, the number of voice commands to be uttered by the operator decreases and the burden on the operator decreases significantly.

Thus, starting, stopping, speed adjustment and setting upon movement of the attachment can be performed by voice in this manner.

Further, when another sole operation is to be performed after the attachment is stopped once, the shear 401 can be moved directly by uttering a voice command for the movement, and the complexity involved in utterance of the voice command for starting every time can be eliminated.

Furthermore, for different operations through which a plurality of movement patterns are performed simultaneously like a rotational operation of the shear 401 and a grasping operation of the shear 401, a voice command corresponding to an interlocking movement which includes the combination of the plurality of movements is prepared in advance. Therefore, the operator is released from the complexity in that all movements must be performed and can concentrate its attention only upon one movement. Accordingly, the working efficiency is improved significantly and the safety upon working is improved.

Further, since a working situation of the attachment is conveyed to the operator through speech synthesis, the working efficiency of the operator is improved as well.

It is to be noted that the present invention is not limited to the embodiment described above, and variations and modifications can be made without departing from the scope of the present invention.

The present invention is not limited to the hydraulic excavator 80 described above but can be applied to other construction machines with which, for example, both hands are used for their working operation.

INDUSTRIAL APPLICABILITY OF THE INVENTION

As described above, according to the voice attachment control apparatus for a construction machine of the present invention, the burden on the operator can be reduced significantly, and the operator can concentrate its attention upon an operation of another actuator, which improves the safety.

Further, according to the voice attachment control method for a construction machine of the present invention, the burden on the operator in excessive utterances is decreased. Furthermore, the operator can perform a rotating operation and a grasping operation simultaneously, by which improvement in operability can be achieved.

The invention claimed is:

1. A voice attachment control apparatus, comprising:

speech analysis means for speech-analyzing a voice command representative of an instruction regarding operation of an attachment element of a construction machine, the construction machine including the attachment element, actuating means connected to the attachment element to actuate the attachment element and an operator cab for accommodating an operator to operate the attachment element;

speech discrimination means for discriminating the instruction of the voice command analyzed by said speech analysis means, the voice instruction being issued by the operator in the operator cab; and machine body control means for controlling the operation of the attachment element according to the voice instruction being discriminated by said speech discrimination means, wherein the machine body control means can perform a plurality of movements of the attachment element simultaneously based on the voice instruction issued by the operator.

2. A voice attachment control apparatus according to claim 1, wherein when said speech analysis means analyzes a first voice command and said speech discrimination means discriminates that the n of the first voice command is to start the operation of the attachment element, said machine body control means starts the operation of the attachment element, when said speech analysis means analyzes a second voice command and said speech discrimination means discriminates that the instruction of the second voice command is to make the attachment element carry out a first movement, said machine body control means controls the attachment element to carry out the first movement, when said speech analysis means analyzes a third voice command and said speech discrimination means discriminates that the instruction of the third voice command is to make the attachment element stop the first movement, said machine body control means controls the attachment element to stop the first movement, and when said speech analysis means analyzes a fourth voice command and said speech discrimination means discriminates that the instruction of the fourth voice command is to make the attachment element carry out a second movement, said machine body control means controls the attachment element to carry out the second movement.

3. A voice attachment control apparatus according to claim 1, wherein when said speech analysis means analyzes a particular voice command and said speech discrimination means discriminates that the instruction of the particular voice command is to make the attachment element carry out a plurality of interlocked movements, said machine body control means controls the attachment element to carry out the plural interlocked movements.

4. A voice attachment control method, comprising:

speech-analyzing a voice command representative of an instruction regarding operation of an attachment element of a construction machine, the construction machine including the attachment element, actuating means connected to the attachment element to actuate the attachment element and an operator cab for accommodating an operator to operate the attachment element;

discriminating the instruction of the voice command analyzed in said step of speech-analyzing, the voice instruction being issued by the operator in the operator cab; and controlling the operation of the attachment element according to the voice instruction being discriminated in said step of discriminating, wherein the machine body control means can perform a plurality of movements of the attachment element simultaneously based on the voice instruction issued by the operator.

5. A voice attachment control method according to claim 4, wherein said steps of speech-analyzing, discriminating and controlling are carried out repeatedly, and when a first voice command is analyzed in said step of speech-analyzing and it is discriminated in said step of discriminating that the instruction of the first voice command is to start the operation of the attachment element, the operation of the attachment element is started in said step of controlling, when a second voice command is analyzed in said step of speech-analyzing and it is discriminated in said step of discriminating that the instruction of the second voice command is to make the attachment element carry out a first movement, the attachment element is controlled to carry out the first movement in said step of controlling, when a third voice command is analyzed in said step of speech-analyzing and it is discriminated in said step of discriminating that the instruction of the third voice command is to make the attachment element stop the first movement, the attachment element is controlled to stop the first movement in said step of controlling, and when a fourth voice command is analyzed in said step of speech-analyzing and it is discriminated in said step of discriminating that the instruction of the fourth voice command is to make the attachment element carry out a second movement the attachment element is controlled to carry out the second movement in said step of controlling.

6. A voice attachment control method according to claim 4, wherein when a particular voice command is analyzed in said step of speech-analyzing and it is discriminated in said step of discriminating that the instruction of the particular voice command is to make the attachment element carry out a plurality of interlocked movements, the attachment element is controlled to carry out the plural interlocked movements in said step of controlling.

* * * * *